US006578473B1

(12) United States Patent
Strebel

(10) Patent No.: US 6,578,473 B1
(45) Date of Patent: Jun. 17, 2003

(54) CALENDER WITH ADJUSTABLE ROLL SUPPORTS

(75) Inventor: Richard M. Strebel, Appleton, WI (US)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/027,121

(22) Filed: Dec. 20, 2001

(51) Int. Cl.[7] ..... B30B 3/04
(52) U.S. Cl. ..... 100/163 R; 100/169; 100/327
(58) Field of Search ..... 100/155 R, 168, 100/172, 163 R, 162 R, 164, 162 B, 169, 163 A, 170, 327

(56) References Cited

U.S. PATENT DOCUMENTS 4,266,475 A * 5/1981 Lamon et al. ..... 100/168
5,029,521 A * 7/1991 Pav et al. ..... 100/38
5,738,007 A * 4/1998 Roerig et al. ..... 100/327
5,988,055 A * 11/1999 Cramer ..... 100/163 R

FOREIGN PATENT DOCUMENTS

WO WO 02/06584 A1 1/2002

* cited by examiner

*Primary Examiner*—Allen Ostrager
*Assistant Examiner*—Jimmy Nguyen
(74) *Attorney, Agent, or Firm*—Lathrop & Clark LLP

(57) ABSTRACT

A supercalender has a top roll, a bottom roll, and a plurality of intermediate rolls. The intermediate rolls are mounted to support frames by pivot arms. The pivot radius defined by the arms is at least about 2½ times the diameter of the largest intermediate roll. Hydraulic load support cylinders are arranged between the intermediate roll bearings and anchor points which are spaced away from the intermediate rolls, to allow greater movement without mechanical interference between hydraulic load support cylinders. The greater length of the pivot arms combined with a greater stroke of the load support cylinders allows the supercalender to accommodate filled rolls which change diameter substantially over their life, as the surface of the rolls is repeatedly turned down to refurbish the roll surface. The calender may be based on an existing calender of the closed A-frame type. One half of each A-frame in the machine direction is removed and a weldment is bolted to the track of each remaining frame along which the bearing housings of the calender rolls formally rode.

28 Claims, 3 Drawing Sheets

CALENDER WITH ADJUSTABLE ROLL SUPPORTS

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to calenders in general, and to supercalenders in particular.

A calender, particularly a supercalender, can increase the value of the paper manufactured on a papermaking machine without increasing the cost of fiber, and with only a small increase in energy cost. By improving the surface finish or other attributes of the paper web, the value of the paper is increased without otherwise modifying the papermaking machinery or process. Because of the large fixed costs and high production rates typically involved in paper manufacture, increasing the value of the paper produced can be a particularly advantageous way to increase revenue produced by a papermaking machine.

A supercalender is comprised of a stack of rolls, sometimes as many as ten, eleven, or more, which form a plurality of nips through which the paper web is directed. Pressure and often heat are applied to the web as it passes through the nips of the supercalender. A supercalender can impart an improved, or more valuable surface finish, can correct curl, and can improve paper caliper variations.

Improving the supercalender has involved controlling the nip force between adjacent rolls by supporting each roll independently of the other rolls in the stack of rolls; the use of crown control rolls, and the use of higher roll temperatures. The use of higher roll temperatures requires an ability to rapidly open a calender stack so that the high-temperature rolls do not overheat opposed compliant rolls when a paper break occurs.

Where a plurality of intermediate rolls are mounted between a fixedly mounted, variable-crown upper roll and a movable variable-crown lower roll, one known technique for controlling inter roll nip loading is to mount the intermediate roll bearings on pivot arms. The pivot arms can be supported by support cylinders as disclosed in U.S. Pat. No. 4,901,637 to Hagel et al.; U.S. Pat. No. 5,438,920 to Koivukunnas et al.; U.S. Pat. No. 5,806,415 to Lipponen et al.; and U.S. application Ser. No. 09/303,587 (PCT/FI98/00392), filed May 7, 1998, claiming priority from U.S. provisional application 60/045,871 to Maenpaa et al., which are each incorporated herein by reference. The support cylinders allow control of the nip loading between each of the supercalender rolls.

A supercalender may employ rolls of varying diameters and of different types. One type of roll has a polymer roll cover. The resilient roll cover provides a wider nip due to compression of the roll at the nip between rolls. Polymer covered rolls have a relatively long life and require only relatively small reductions in diameter due to refinishing the roll surface during the life of the roll. Smooth metal rolls provide a hard smooth surface against which the paper is compressed. Although metal rolls may be refinished, relatively little material is removed over time. Metal rolls may be heated, typically by hot water, steam or induction heating. Another type of known roll is a filled roll which is comprised of a large number of disks of a material like cotton, flax, or paper. Each disk has a central hole and thousands of individual disks or sheets are stacked up on a metal core and compressed axially at very high pressures. The resulting roll is finished by turning the surface of the roll formed by the compressed disks of fabric or paper. The surface of a filled roll has a relatively short service life requiring frequent machining so that a filled roll decreases substantially in diameter over the life of the roll.

Many existing calenders are of the closed frame, or A-frame type, which means the roll bearings at the ends of the individual calender rolls making up the supercalender are held between pairs of vertical frames, which are joined at the top. In these existing calenders, the rolls have bearings which slide on rails between the vertical frames. Nip loading between rolls making up the calender can be controlled only by loading the uppermost roll, which means each successively lower nip has an increased nip loading as the weight of each successive roll adds to the total nip load.

A conventional closed calender cannot rapidly open the nips. Rapid nip opening protects polymer and fiber rolls from damage caused by wads of paper passing through the calender nips. Typically photoeye and web tension sensors detect a paper break and instigate rapid nip opening so that wads of paper formed during a break can pass between calender rolls without damaging them. Existing solutions to rebuilding calenders do allow support of individual rolls by hydraulic pistons which extend between a support frame and the roll bearings. Existing systems, however, do not provide sufficient vertical movement of the roll bearings to accommodate a variety of roll diameters, particularly the ability to accommodate the diameter change of filled rolls over time.

A calender or calender rebuild design is needed which can accommodate a wide variety of calender rolls, and facilitate the use of filled rolls by accommodating the substantial change in roll diameter overtime.

SUMMARY OF THE INVENTION

The calender of this invention may be based on an existing calender of the closed A-frame type. One half of each A-frame in the machine direction is removed and a weldment is bolted to the track of each remaining frame along which the bearing housings of the calender rolls formally rode. Each weldment rests on the calender foundation and consists of two parallel plates which extend in the machine direction 72 inches away from the remaining frames. The lower portion of each weldment has a vertical rail along which the bearing housings of a bottom roll rides. The bottom roll mounted to the bottom bearing is supported by a bottom cylinder which controls the bottom roll's vertical movement and the opening and closing of the calender roll stack.

A top calender roll is fixedly mounted between the weldments. A plurality of intermediate calender rolls are mounted by pivot arms to the weldments, so that each intermediate calender roll is supported on each end by two pivoting arms. Each arm has two plates which extend between the roll end bearing, and extend along either side of the weldment to bearing pins located adjacent to the upstream side of the weldment where the weldment is bolted to the track of the existing frames.

The bearing housings of each roll connect the two plates of each arm to form a single integrated pivot arm. The bearing housings incorporate a stop so that each bearing housing on each pair of pivot arms, when pivoting downwardly comes to rest on resilient pads mounted to weldment stops which extend like teeth from the sides of the weldments. The weldment is substantially open ended, opposite the calender rolls.

Positioned within the sides of the weldments are pairs of load supporting cylinders which extend between cylinder brackets which span the sides of the weldments and piston mounting brackets which extend from the calender roll bearing housings. The piston mounting brackets are narrower than the weldment and fit within the sides of the weldment and between the weldment stops on which rubber pads are mounted, thus accommodating the stroke of the load supporting cylinders without interference of the supporting weldment.

The greater length of the pivot arms combined with the greater stroke of the load support cylinders allows the supercalender to accommodate filled rolls which change diameter substantially over their life, as the surface of the rolls is repeatedly turned down to refurbish the roll surface.

It is an object of the present invention to provide a supercalender which can accommodate calender rolls of varying diameter.

It is another object of the present invention to provide a supercalender in which greater vertical motion of individual calender rolls is provided for.

It is a further object of the present invention to provide a supercalender which can control the nip load on intermediate calender rolls.

It is a still further object of the present invention to provide a supercalender in which intermediate rolls are mounted on pivot arms which minimize lateral displacement of the rolls when they are pivoted on the arms.

Further objects, features and advantages of the invention will be apparent from the following detailed description when taken in conjunction with the accompanying drawings.

DESCRIPTION OF THE PREFERRED EMBODIMENTS

Figure 1:
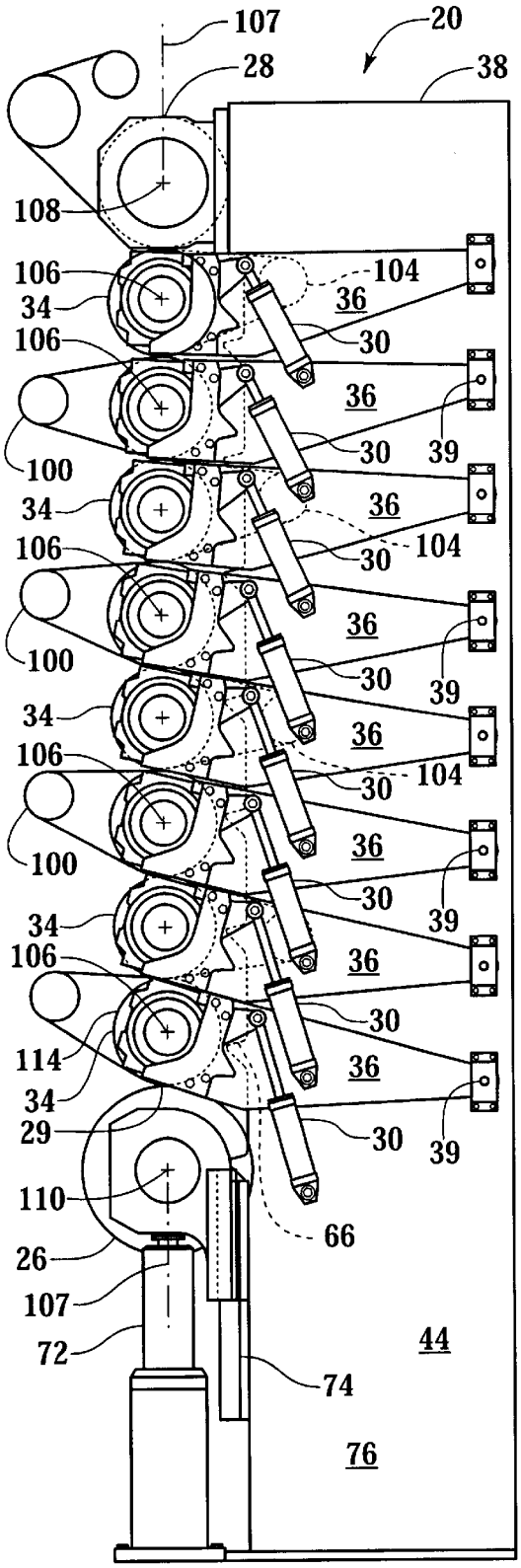
FIG. 1 is a side elevational view of the supercalender rebuild of this invention in the closed position.
Figure 2:
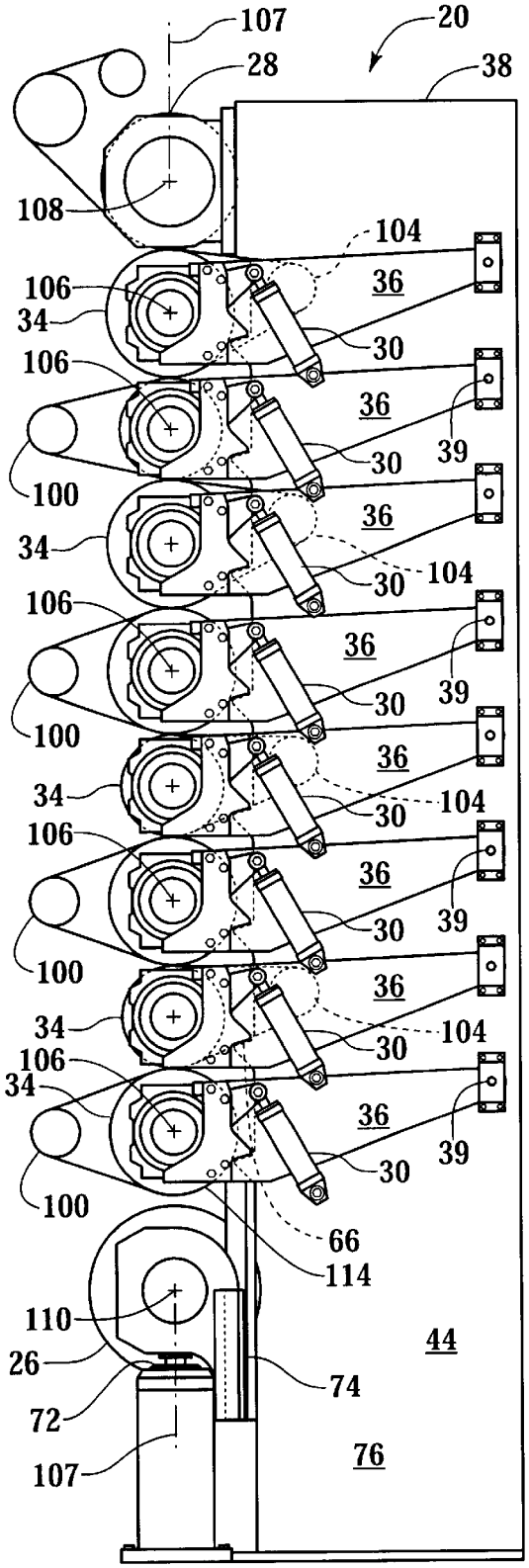
FIG. 2 is a side elevational view of the supercalender rebuild of this invention shown in the open position.

Referring more particularly to FIGS. 1–4, wherein like numbers refer to similar parts, a calender 20 is shown in FIGS. 1 and 2. The calender 20 has two spaced apart frames 24 to which weldments 38 are bolted. A top roll 28 is mounted on the weldment 38 for rotation. A bottom roll 26 is mounted for vertical motion on hydraulic pistons 72 and is slidably mounted to the weldment 38. A plurality of intermediate rolls 34 are placed one above another, so that when the top roll 28, bottom roll 26 and intermediate rolls 34 are brought together they form calender nips 29 therebetween.

The calender 20 may be constructed as a rebuild where the rolls 26, 28, 34 of an existing calender, and portions of the frame 24 of an existing calender are used in the construction of a new calender 20. Because of the considerable cost of the calender rolls generally, and particularly of the bottom roll 26 and the top roll 28 which will normally be variable-crown rolls, reuse of the calender rolls will save considerable cost. Reuse of the part of the frame 24 saves the cost and time of constructing a new frame and foundation.

In a supercalender, where a plurality of intermediate calender rolls are positioned between a lower variable-crown roll and a upper variable crown roll, the nip loading uniformity could be controlled by the variable-crown rolls, except for the fact that the rolls extended beyond the paper engaging nip, and relatively heavy roll bearings are cantilevered off the ends of the rolls. In addition, in a conventional supercalender each successive nip must have a higher linear nip load because each roll must support the weight of all the rolls position above it.

The weight of the bearings and the unsupported portions of the rolls cause a downward deflection of the roll ends. Mounting the roll bearings to arms which are supported by hydraulic loading cylinders allows the weight of the unsupported portion of the rolls plus the bearing housings to be supported. As explained more fully in U.S. patent application Ser. No. 09/303,587 (PCT/FI98/00392), the loading angle which defines the linear loading of intermediate rolls can also be controlled by the use of hydraulic loading cylinders which are mounted to support the arms to which the roll bearings are mounted.

Figure 3:
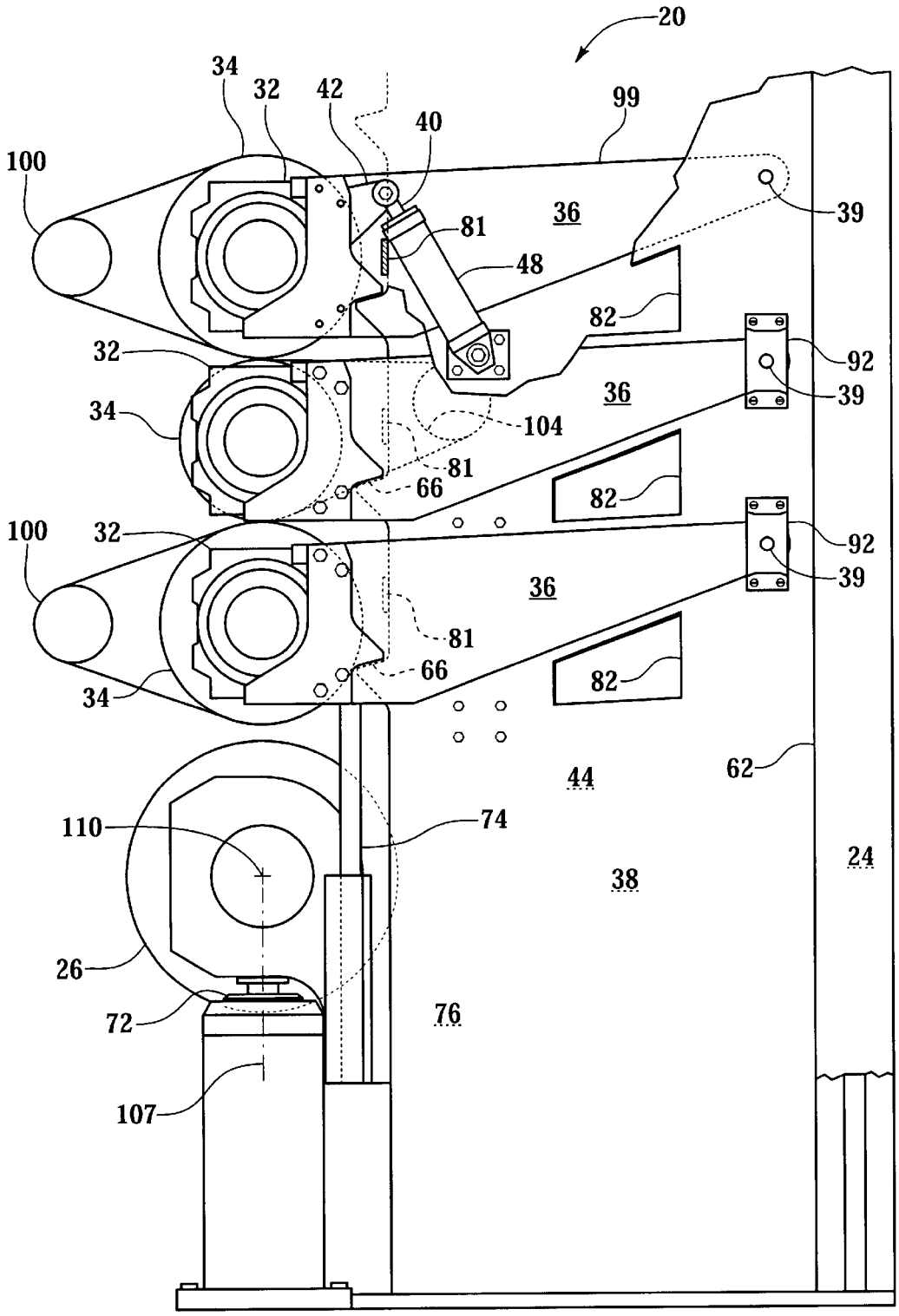
FIG. 3 is a broken away side elevational view of the supercalender rebuild of FIG. 1.
Figure 4:
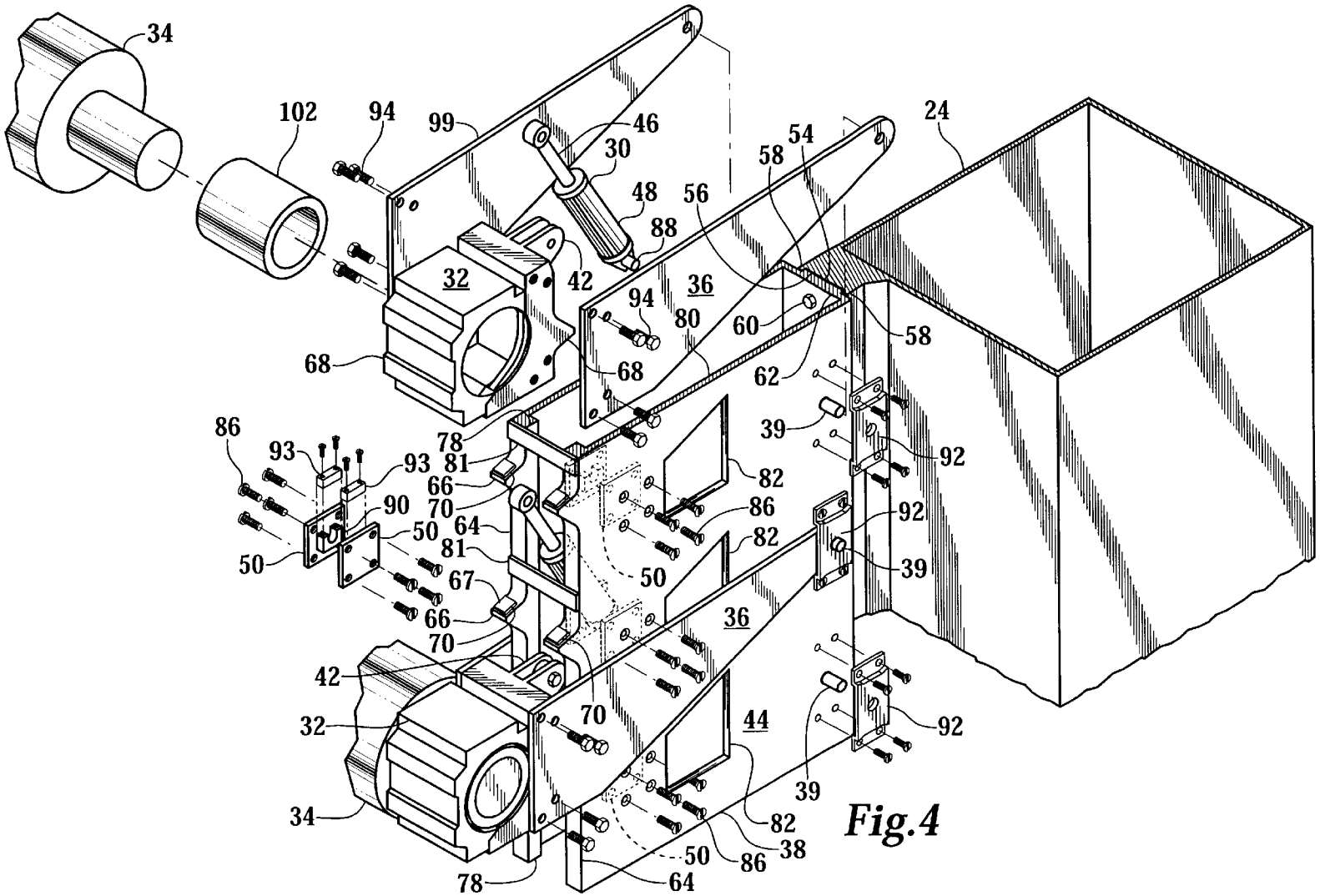
FIG. 4 is an exploded isometric view of the supercalender rebuild of FIG. 1.

Referring to FIGS. 1 and 2, the calender 20 provides the benefit of using hydraulic loading cylinders 30 to support the bearing housings 32 of the intermediate rolls 34 which are mounted on the arms 36. The roll support arms 36 are mounted to a weldment 38 by pivots 39. The weldment 38 is bolted to an existing calender frame 24, as shown in FIG. 4. The loading cylinders 30 are arranged so that the extension of the pistons 46 do not interfere with the mounting of the loading cylinder 30 of the next higher intermediate roll 34, as shown in FIG. 1. The bearing housings 32 of each intermediate roll have piston mounting brackets 42 which extend towards and partly between the sides 44 of the weldment 38, as shown in FIGS. 3 and 4. Hydraulic loading cylinders 30 is comprised of the piston 46 which is mounted to the piston mounting bracket 42 and a hydraulic cylinder 48 which is mounted between lower support cylinder brackets 50 which are mounted between the two spaced apart vertical walls 44 of the weldment 38.

The lower support cylinder brackets 50 are mounted below the piston mounting brackets 42 and spaced inwardly towards the pivots 39 which mount the arms 36. The position and arrangement of the hydraulic loading cylinders 30, and the way in which they are substantially contained within the weldment 38 allows greater extension of the hydraulic loading cylinder pistons 46, without the interference between cylinders inherent in the prior art. The greater extension of the hydraulic loading cylinder pistons 46 allows greater vertical movement of the intermediate rolls 34. Greater movement of the intermediate rolls 34 allows the supercalender to accommodate fiber rolls which decrease in diameter substantially over their useful life. Greater vertical movement also facilitates substituting different intermediate rolls as may be required by a particular grade of paper.

Referring to FIGS. 2 and 3, a rebuilt calender 20 is constructed by tearing down an existing closed calender A-frame (not shown) to leave a single frame 24 consisting of the up machine direction portion of the A-frame of the pre-existing calender, on both the front frame 24 and back (not shown) of the pre-existing calender. The front frame 24 has a track 54 along which previously the bearing housings of the intermediate rolls rode. The weldment 38 has a protruding land 56 which fits within the sides 58 of the track 54. Bolts 60 mount the weldment 38 to the track 54 of the front frame 24. The weldment 38 extends over the foundation previously occupied by the portion of the A-frame which was removed.

The weldment has a back 62 and two sides 44 and downstream edges 64 which are thicker than the sides 44 and support one pair of triangular teeth 66 for each intermediate roll 34. The triangular teeth 66 have upwardly facing surfaces 67 on which are mounted resilient pads 70 and which form stops, which support the intermediate rolls 34, when the calender 20 is in the open position, as shown in FIG. 2. Corresponding teeth 68 are formed on the bearing housings 32 of the intermediate rolls 34. As shown in FIG. 2, when the calender 20 stack is opened by moving the bottom roll 26 down by means of the bottom roll support cylinder 72, the intermediate rolls 34 come to rest on the upwardly facing surfaces 67 and resilient pads 70 of the triangular teeth 66 which engage the bearing housing teeth 68. As shown in FIG. 3, the bearing housing of the bottom roll 26 slides along a track 74 formed on lower portions 76 of the weldment 38.

A gap 78 is formed between the downstream edges 64, of the weldment 38. The gap opens into the interior 80 of the weldment 38. In contradistinction to the prior art, where the hydraulic load cylinders are mounted substantially along the downstream edges of the calender support, the hydraulic loading cylinders 30 of the calender 20 are mounted substantially within the interior 80 of the weldment 38. The downstream edges 64 of the weldment sides 44 may be tied together for increased stiffness by short bars 81 which extend between the weldment sides 44. The short bars 81 are positioned to avoid interference with the hydraulic load cylinders 30. Assembly of the calender 20 is facilitated by access openings 82 which facilitate positioning pairs of opposed bracket parts which form the lower support cylinder brackets 50 which are mounted to the sides 44 of the weldment with bolts 86.

The access openings 82 also facilitate positioning the lower portions 88 of the hydraulic cylinders 48 within the grooves 90 in the bracket parts 50. The bracket parts 50 may also be joined by through bolts (not shown) which tie the weldment sides 44 together. In addition, the lower portions 88 of the hydraulic cylinders 48 may be held within the brackets by keys 93 which prevent the hydraulic cylinders 48 from being inadvertently lifted out of the grooves 90. The pivotal arms 36 are mounted over the pivots 39 which extend outwardly of the weldment sides 44, closely spaced from the back 62 of the weldment 38. Pivot brackets 92 overlie the arms 36 and the pivots 39 to provide stronger support to the pivots 39. The pivot arms 36 are bolted by bolts 94 to ductile cast iron bearing housings 32, on which the piston mounting brackets 42 are integrally formed.

During assembly, the bearing housings 32 with attached hydraulic load cylinders 30 are bolted to the pivot arms 36. The bottom of the roll support cylinder 72 may then be positioned the lower portions 88 through access openings 82 so the lower portions 88 ride with in the grooves 90 of the bracket parts 50. The intermediate rolls 34, as shown in FIG. 3, are mounted by bearings 102 within the bearing housings 32. Referring to FIGS. 1 and 2, an inside flyroll 104 is mounted to the inside part 99 of the pivot arm 36. Alternatively, an outboard flyroll 100 is mounted to a bracket on the bearing housing 32.

The top roll 28 is fixedly mounted, as shown in FIGS. 1 and 2, to the weldment 38. All loading of the calender stack is performed by the bottom roll 26 which, as previously described, slides along the track 74 formed on lower portions 76 of the weldment 38. The calender stack can be rapidly opened, as shown in FIG. 2, by moving the bottom roll 26 downwardly and allowing the pivot arm 36 to come to rest on the upwardly facing surfaces 67 of the teeth 66. In the open position, gaps of at least about 0.19 inches are formed between each intermediate roll and the preceding roll.

In combination with a greater stroke of the hydraulic loading cylinders 30, the pivot arms will have a correspondingly greater swing radius between the axis 106 of the intermediate the rolls 34, and a pivot axis defined by the pivots 39. Pivoting the arms 36 results in not only vertical movement of the intermediate rolls, but a small horizontal or machine direction motion so that the individual intermediate rolls may not be positioned precisely above, or precisely below another intermediate roll 34 or the top roll 28 or bottom roll 26. To the extent any intermediate roll 34 forms a nip which is offset from a calender plane 107 extending between the axis 108 of the top roll 28 and the axis 110 of the bottom roll 26, lateral forces will be developed in the pivot pins 39. The lateral forces are related to the amount of lateral offset of the intermediate roll 34 axis 106. These lateral offsets are minimized by positioning the pivot pins 39 and the stops formed by the upwardly facing surfaces 67 to position each intermediate roll so that the intermediate roll axes 106 are initially positioned to the right as viewed in FIGS. 1 and 2 of the calender plane 107 extending between the axes 108, 110 of the top and bottom rolls. The pivot arms 36 are arranged so that the intermediate roll axes 106 cross the plane 107 twice, thus reducing the total angular displacement of the intermediate roll axes 106, away from the calender plane 107, by a factor of four, and the lateral displacement by more than a factor of ten.

The calender 20 achieves an ability to accommodate greater vertical movement in a calender where the rolls are mounted to pivot arms, by using the arms which in proportion to the diameter of the intermediate rolls, are substantially longer, so that intermediate roll diameter is about 40 percent or less of the pivot radius defined between the intermediate roll axis 106, and the pivots 39, and by placing the hydraulic loading cylinders 30 in the overlapping diagonal arrangement as shown in FIGS. 1 and 2 so that greater extension of the hydraulic loading cylinders 30 is possible without interference between cylinders. In the prior art, hydraulic loading cylinders are positioned substantially in a vertical line, and thus each loading cylinder could only extend until it came into interference with the loading cylinder immediately above.

The calender 20, as shown in FIGS. 1 and 2, has a top roll diameter which begins life with a diameter of 34.28 inches, and a bottom roll which begins life with a diameter of 42 inches. The intermediate rolls, depending on roll type, vary between 32 inches for filled rolls, 28.8 in. for polymer rolls, and 24.7 inches for thermal rolls. The rolls will decrease in diameter, in a manner known in the art, due to periodic resurfacing by a turning down of the roll diameters, with the amount of roll diameter reduction being dependent on the roll type. FIG. 2 shows the calender 20 in the open position with maximum diameter rolls, and the rolls resting on stops formed by the surfaces 67 of the triangular teeth 66. FIG. 1 shows the calender 20 in a closed position with minimum diameter rolls. The total vertical motion of the bottom roll axes is thirty inches between FIG. 1 and FIG. 2. The pivot radius defined between the intermediate roll axes 106 and the center of the pivots 39 is eighty inches. For the lowermost intermediate roll 114, which has a maximum angular motion of about 17 degrees, and a maximum vertical motion of the roll axes of about twenty-four inches, or about 30 percent of the pivot radius. The roll has a maximum horizontal displacement of the roll axes of about 0.45 inches from the calender plane 107, which is less than one percent of the pivot radius, with the actual displacement of the nip formed between the lowermost intermediate roll 114 and the bottom roll 26, or the roll immediately above being displaced about a maximum of 0.41 inches from the calender plane 107 and it is this last displacement which controls the amount of lateral loads developed at the pivot arm 36 pivots 39.

The intermediate roll 34 immediately above the lowermost intermediate roll 114 has a smaller vertical motion, approximately twenty-one and one half inches or slightly more than twenty-five percent of the pivot radius and proportionately less horizontal displacement. Less vertical motion is required of the intermediate rolls 34 as the top roll 28 is approached, so that the horizontal motion can be to less than one percent of the pivot radius, without necessarily causing the axis of the intermediate rolls 34 to pass twice through the calender plane 107. The calender plane 107 could be tilted with respect to the vertical, in which case the horizontal and vertical displacements are measured as parallel and perpendicular to the calender plane.

It should be understood that the calender rolls 26, 28, 34 are supported on either end by mirror image frames, arms, and load support cylinders. The rolls having a typical cross machine direction width which is greater than the width of the paper web being calendered which, for an on-machine calender, may be several hundred inches wide.

It should be understood that the calender 20 may be constructed as a rebuild calender or as a new calender.

It should be understood that in the claims the term support frame refers to the structure to which the pivot arms are mounted, whether that is a weldment, a weldment plus an existing frame, or simply a frame, however constructed, which supports the pivot arms.

It should be understood that in the claims the terms support cylinders includes hydraulic cylinders, pneumatic cylinders, electric actuators, air rides/air bags, and other types of actuator.

It is understood that the invention is not limited to the particular construction and arrangement of parts herein illustrated and described, but embraces all such modified forms thereof as come within the scope of the following claims.

I claim:

1. A calender comprising:

two spaced apart support frames, each support frame comprised of two spaced apart vertical walls;

a top roll mounted between two top bearings, each top bearing mounted fixed with respect to the support frame;

a bottom roll mounted between two bottom bearings, the bottom bearings mounted for vertical motion with respect to the support frames;

a plurality of intermediate rolls placed one above another, so that when the top roll, bottom roll and intermediate rolls are brought together they form a plurality of calender nips therebetween;

wherein each intermediate roll is positioned between opposed bearings which are mounted to bearing housings which are mounted to arms which are mounted by pivots to the support frames;

each bearing housing having a portion which extends between the spaced apart vertical walls of one of said support frames, the portion forming an upper support cylinder attachment bracket; and a support cylinder extending between each upper support cylinder attachment bracket on the bearing housings and a lower support cylinder bracket mounted between the spaced apart vertical walls of one of said support frames, the lower support cylinder bracket being mounted below the upper support cylinder attachment bracket and spaced inwardly towards the pivots on the support frames, so that a greater vertical motion of each intermediate roll is provided.

2. The calender of claim 1 wherein the bottom bearings are slidably mounted to the support frames and are mounted for vertical motion on hydraulic pistons.

3. The calender of claim 1 wherein each intermediate roll rotates about a first axis, and the arms to which said intermediate roll are mounted pivot on the support frames about a second axis, and wherein a pivot radius length is defined between the first axis and the second axis, each intermediate roll having a diameter which is less than about 40 percent of the pivot radius length.

4. The calender of claim 3 wherein the diameter of each intermediate roll is between about 40 percent and about 30 percent of the pivot radius length.

5. The calender of claim 1 wherein each intermediate roll rotates about an intermediate axis, and wherein the top roll rotates about a top roll axis, and the bottom roll rotates about a bottom roll axis, the top roll axis and the bottom roll axis defining a calender plane, and wherein the support cylinders are extensible to cause the axis of each intermediate roll to pass through the calender plane twice as the support cylinders are extended.

6. The calender of claim 1 wherein each spaced apart vertical wall has a downstream edge which faces the intermediate rolls, and further comprising:

first projections extending outwardly of and formed on the downstream edges of each spaced apart vertical wall; and inwardly extending second projections on each bearing housing, positioned to limit the downward motion of the intermediate rolls, by engaging with the first projections of each spaced apart vertical wall.

7. The calender of claim 1 wherein the intermediate rolls include filled rolls, polymer rolls, and thermal rolls.

8. The calender of claim 1 wherein the bottom roll, and the top roll are variable-crown rolls.

9. The calender of claim 1 wherein at least one of each two spaced apart vertical walls has portions forming access openings to a space defined between the spaced apart vertical walls, to give access to the lower support cylinder brackets.

10. The calender of claim 1 wherein at least one fly roll is mounted between the arms.

11. The calender of claim 1 wherein at least one fly roll is mounted to and between the bearing housings of at least one intermediate roll.

12. The calender of claim 1 wherein each spaced apart vertical wall has a downstream edge which faces the intermediate rolls, and further comprising a plurality of bars connecting the two spaced apart vertical walls of each of the two spaced apart vertical frames along the downstream edge, to stiffen the vertical frames by connecting the two spaced apart vertical walls.

13. A calender comprising:

two spaced apart support frames;

a top roll mounted between two bearings, each bearing being mounted to one of said support frames, the top roll defining an axis about which the top roll rotates;

a bottom roll mounted between two bearings, the bottom roll being positioned below and spaced from the top roll, the bottom roll defining an axis about which the bottom roll rotates, the axis of the top roll and the axis of the bottom roll defining a calender plane;

a plurality of intermediate rolls, positioned between the top roll and the bottom roll, each intermediate roll having a selected diameter, and each intermediate roll rotating about a roll axis, the intermediate rolls being placed one above another, so that when the top roll, bottom roll and intermediate rolls are brought together they form a plurality of calender nips therebetween;

wherein each intermediate roll is pivotally mounted by arms to pivots on the support frames, the arms being pivotable about a pivot axis extending through the pivots, wherein a pivot radius is defined between each intermediate roll axis and the pivot axis of the arms which mount said intermediate roll, wherein each intermediate roll diameter is less than about 40 percent of the pivot radius; and a pair of support cylinders extending between each intermediate roll and the frames, the support cylinders being mounted to the frames and extensible to cause the axis of each intermediate roll to pass through the calender plane twice as the support cylinders are extended.

14. The calender of claim 13 wherein the diameter of each intermediate roll is between about 40 percent and about 30 percent of the pivot radius.

15. The calender of claim 13 wherein each support frame has a downstream edge which faces the intermediate rolls, and further comprising:

first projections which extending outwardly of and are formed on the downstream edges of each frame; and bearing housings rotatable mounting each intermediate roll to two arms;

inwardly extending second projections on each bearing housing, positioned to limit the downward motion of the intermediate rolls by engaging with the first projections of the support frames.

16. The calender of claim 13 wherein the intermediate rolls include filled rolls, polymer rolls, and thermal rolls.

17. The calender of claim 13 wherein the bottom roll, and the top roll are variable-crowned rolls.

18. The calender of claim 13 wherein the at least one fly roll is mounted between the arms mounting at least one intermediate roll to the support frames.

19. The calender of claim 13 wherein bearing housings rotatably mount each intermediate roll to two arms, and further comprising at least one fly roll mounted to and between the bearing housings of at least one intermediate roll.

20. The calender of claim 13 wherein each support frame comprises a weldment having two spaced apart vertical walls connected by a back wall, the back wall bolted to a salvaged half of an A-frame.

21. A calender comprising:

two spaced apart support frames, each support frame comprised of two spaced apart vertical walls;

a top roll mounted between two top bearings, each top bearing mounted fixed with respect to the support frame;

a bottom roll mounted between two bottom bearings, the bottom bearings mounted for vertical motion on hydraulic pistons and slidably mounted to the support frames;

a plurality of intermediate rolls placed one above another, so that when the top roll, bottom roll and intermediate rolls are brought together they form a plurality of calender nips therebetween;

wherein each intermediate roll is positioned between opposed bearings which are mounted to bearing housings which are mounted to arms which are mounted by pivots to the support frames;

each bearing housing having a portion forming upper support cylinder attachment brackets; and a support cylinder extending between each upper support cylinder attachment bracket on the bearing housings and a lower support cylinder bracket mounted on one of said support frames, the lower support cylinder bracket being mounted below the upper support cylinder attachment bracket and spaced inwardly towards the pivots on the support frames, so that a greater vertical motion of each intermediate roll is provided;

wherein each intermediate roll rotates about a first axis, and the arms to which said intermediate roll are mounted pivot on the support frames about a second axis, and wherein a pivot radius length is defined between the first axis and the second axis, each intermediate roll having a diameter which is less than about 40 percent of the pivot radius length.

22. The calender of claim 21 wherein the diameter of each intermediate roll is between about 40 percent and about 30 percent of the pivot radius length.

23. A calender comprising:

two spaced apart support frames;

a top roll mounted between two bearings, each bearing being mounted to one of said support frames, the top roll defining an axis about which the top roll rotates;

a bottom roll mounted between two bearings, the bottom roll being positioned below and spaced from the top roll, the bottom roll defining an axis about which the bottom roll rotates, the axis of the top roll and the axis of the bottom roll defining a calender plane;

a plurality of intermediate rolls, positioned between the top roll and the bottom roll, each intermediate roll having a selected diameter, and each intermediate roll rotating about a roll axis, the intermediate rolls being placed one above another, so that when the top roll, bottom roll and intermediate rolls are brought together they form a plurality of calender nips therebetween;

wherein each intermediate roll is pivotally mounted by arms to pivots on the support frames, the arms being pivotable about a pivot axis extending through the pivots, wherein a pivot radius is defined between each intermediate roll axis and the pivot axis of the arms which mount said intermediate roll, the pivot radius being greater than 61.75 inches; and a pair of support cylinders extending between each intermediate roll and the frames, the support cylinders being mounted to the frames and extensible to cause the axis of at least one intermediate roll to pass through the calender plane twice as the support cylinders are extended, and to move the axis of the at least one intermediate roll a distance parallel to the calender plane approximately equal to or greater than twenty-one and one half inches while causing motion perpendicular to the calender plane of less than about 0.45 inches.

24. The calender of claim 22 wherein the diameter of the at least one intermediate roll is between about 40 percent and about 30 percent of the pivot radius.

25. The calender of claim 22 wherein each support frame has a downstream edge which faces the intermediate rolls, and further comprising:

first projections which extend outwardly of and are formed on the downstream edges of each frame; and bearing housings rotatably mounting each intermediate roll to two arms;

inwardly extending second projections on each bearing housing, positioned to limit the downward motion of the intermediate rolls by engaging with the first projections of the support frames.

26. The calender of claim 22 wherein the intermediate rolls include filled rolls, polymer rolls, and thermal rolls.

27. The calender of claim 22 wherein the bottom roll and the top roll are variable-crown rolls.

28. The calender of claim 22 wherein each support frame comprises a weldment having two spaced apart vertical walls connected by a back wall, the back wall bolted to a salvaged half of an A-frame.

* * * * *